US011603829B2

(12) United States Patent
Breuer et al.

(10) Patent No.: US 11,603,829 B2
(45) Date of Patent: Mar. 14, 2023

(54) HYDROSTATIC AXIAL PISTON MACHINE HAVING PRESSURE SIDE CHANGE

(71) Applicant: Robert Bosch GmbH, Stuttgart (DE)

(72) Inventors: David Breuer, Tuebingen (DE); Timo Nafz, Horb (DE)

(73) Assignee: Robert Bosch GmbH, Stuttgart (DE)

( * ) Notice: Subject to any disclaimer, the term of this patent is extended or adjusted under 35 U.S.C. 154(b) by 248 days.

(21) Appl. No.: 17/160,905

(22) Filed: Jan. 28, 2021

(65) Prior Publication Data

US 2021/0254609 A1 Aug. 19, 2021

(30) Foreign Application Priority Data

Feb. 13, 2020 (DE) ..... 10 2020 201 800.6

(51) Int. Cl.

| | |
|---|---|
| ***F04B 1/2042*** | (2020.01) |
| ***F04B 11/00*** | (2006.01) |
| ***F04B 1/324*** | (2020.01) |
| *F04B 1/22* | (2006.01) |

(52) U.S. Cl.

CPC ..... *F04B 1/2042* (2013.01); *F04B 1/324* (2013.01); *F04B 11/0008* (2013.01); *F04B 1/22* (2013.01); *F04B 11/00* (2013.01)

(58) Field of Classification Search

CPC .... F04B 1/2042; F04B 11/00; F04B 11/0008; F04B 2205/16; F04B 49/22; F04B 53/001

See application file for complete search history.

(56) References Cited

U.S. PATENT DOCUMENTS 5,554,007 A * 9/1996 Watts ..... F04B 1/324 91/504
6,510,779 B2 * 1/2003 Greene ..... F04B 49/002 417/270

FOREIGN PATENT DOCUMENTS

DE 102013226344 A1 * 6/2015 ..... F01B 3/0032
EP 2 324 245 B1 2/2012
WO WO-2010025822 A1 * 3/2010 ..... F04B 1/2042

* cited by examiner

*Primary Examiner* — Kenneth Bomberg
*Assistant Examiner* — Matthew Wiblin
(74) *Attorney, Agent, or Firm* — Maginot, Moore & Beck LLP

(57) ABSTRACT

There is disclosed a hydrostatic axial piston machine having a pulse reduction device. This device has a connection location or tap in the transition region in front of the high-pressure-side kidney-like elongate hole of a distributor plate. The connection location or tap is connected by means of one or two hydraulically passively controlled switching valves to a high-pressure store. It is used for precompression and consequently for the pulse reduction. In a development, the distributor plate also has a connection location or tap in the transition region behind the high-pressure-side kidney-like elongate hole. The connection location or tap is connected via one or two hydraulically passively controlled switching valves to a low-pressure store. This is used for the decompression and consequently also for the pulse reduction.

6 Claims, 3 Drawing Sheets

HYDROSTATIC AXIAL PISTON MACHINE HAVING PRESSURE SIDE CHANGE

This application claims priority under 35 U.S.C. § 119 to application No. DE 10 2020 201 800.6, filed on Feb. 13, 2020 in Germany, the disclosure of which is incorporated herein by reference in their entirety.

The disclosure relates to a pulse reduction device for a hydrostatic axial piston machine which is configured for a pressure side change.

BACKGROUND

In axial piston machines, it is known that a plurality of cylinders extend parallel with a rotation axis of a cylinder drum. The cylinders are distributed inside the cylinder drum in a uniform manner over the periphery thereof. In each cylinder, a piston is displaceably guided substantially parallel with the rotation axis.

In axial piston machines with a swash plate construction type, the pistons are coupled by means of respective piston bases to a stationary swash plate which is positioned obliquely with respect to the rotation axis. Therefore, with a rotation about the rotation axis, each piston carries out a stroke, the size of which is dependent on the oblique position of the swash plate. The drive shaft of the axial piston machine also extends along the rotation axis of the cylinder drum.

With axial piston machines of a swash plate construction type, a swash plate is constructed in the manner of a flange on a drive shaft. The drive shaft is positioned together with the swash plate obliquely with respect to the rotation axis of the cylinder drum. Therefore, with this construction type, each piston also carries out with a rotation about the rotation axis a stroke, the size of which is dependent on the oblique position of the drive shaft and the flange-like swash plate.

In both construction types of axial piston machines, on an end face of the cylinder drum which is opposite the swash plate or the obliquely positioned drive shaft, an opening is provided for each cylinder. The openings are connected to the respective cylinder by means of a respective connection channel which is formed inside the cylinder drum. When the cylinder drum rotates with the end face thereof, the openings run along a circular path. The end face is tensioned against two circular-arc-like or kidney-like elongate holes so that the openings run in a sealed manner over these elongate holes. During operation, one of the elongate holes acts as a high-pressure kidney-like member, whilst the other elongate hole acts as a low-pressure kidney-like member. In most cases, both elongate holes are constructed as through-holes in a distributor plate.

SUMMARY

The present disclosure relates to axial piston machines in which a pressure side change for both elongate holes is possible. In the case of a pump, this pressure side change may, for example, be produced by a change of the drive direction of the drive shaft and an associated change of the conveying direction of the pressure medium. With such a pump, a two-quadrant operation is also referred to. If an axial piston machine which is configured for a pressure side change can further in addition to the pump operation also be operated as a motor, a four-quadrant operation is referred to.

When viewed in the peripheral direction of the openings, closed transition regions are provided on the distributor plate between the two elongate holes. If an opening moves over such a transition region, the associated piston passes through a reversal point or dead center.

A problem with such axial piston machines involves the pressure medium pulses which are produced when an opening of a cylinder which is under low pressure travels from a closed transition region over the edge of the high-pressure-side elongate hole and the cylinder in this instance is suddenly acted on with high pressure. With regard to the entire axial piston machine, in all openings such a pressure medium pulse is produced once per rotation.

The publication EP 2 324 245 B1 discloses a pulse reduction device for an axial piston machine with pressure side change. There is set out a precompression volume in a common storage element which can be connected by means of two 3/2-way valves to a respective connection location which is referred to in each case as an outlet. The connection locations are respective small holes in the two closed transition regions. More specifically, a first connection location is arranged in the peripheral direction in front of the first elongate hole, whilst diametrically opposite in the distributor plate the second connection location is arranged in the peripheral direction in front of the second elongate hole. Both 3/2-way valves are switched electrically in a cyclical manner. Consequently, inter alia the pressure medium of each cylinder is pre-compressed before it travels over the elongate hole which is acted on with high pressure.

The disadvantage of such axial piston machines is the technical device and in particular the technical control complexity which is produced for the control of the two 3/2-way valves which are intended to be electrically switched in a manner adapted to the rotation of the cylinder drum.

Accordingly, an object of the disclosure is to provide an axial piston machine with a pulse reduction device whose technical device and technical control complexity are reduced.

This object is achieved by an axial piston machine having the features of the disclosure.

Other advantageous embodiments of the disclosure are described herein.

The disclosed hydrostatic axial piston machine has a rotating cylinder drum, in which there are formed a plurality of cylinders which are connected by means of a respective opening to an end face of the cylinder drum, wherein the openings can be moved along a preferably common circular path. The openings are tensioned against a first circular-arc-like elongate hole and against a second circular-arc-like elongate hole. Both elongate holes act as a switching geometry. Since the axial piston machine is configured for a pressure side change, both elongate holes are resistant to high pressure. A first connection location is provided in a first transition region arranged between the two elongate holes, adjacent to the first elongate hole in a peripheral direction just before the first elongate hole. A second connection location is provided in a second transition region arranged between the two elongate holes, between the two elongate holes adjacent to the second elongate hole in the peripheral direction just before the second elongate hole. Both transition regions extend from one elongate hole to the other. Both connection locations can be connected via a first switching valve arrangement to a high-pressure store.

According to the disclosure, the first switching valve arrangement is connected to the two elongate holes in fluid terms via control pressure lines in such a manner that, if one of the two elongate holes is acted on with high pressure, the adjacent connection location which is arranged in the peripheral direction just before the relevant elongate hole is connected to the high-pressure store, whilst the connection location which is adjacent to the other elongate hole and which is arranged in the peripheral direction just before the relevant elongate hole is blocked with respect to the high-pressure store. A connection location which is "adjacent" to a circular-arc-like elongate hole is intended to be understood in such a manner that the connection location is arranged closer to the adjacent elongate hole than to the other elongate hole.

In the axial piston machine according to the disclosure, the precompression of the cylinders which are moved in the peripheral direction toward the high-pressure-side elongate hole is controlled in accordance with the current pressure relationships at the two elongate holes in a passive and reliable manner via control pressure lines. In the event of a pressure side change, the first switching valve arrangement is switched in a passive and reliable manner and it connects the other connection location to the high-pressure store. Consequently, the technical device complexity and technical control complexity are reduced. The structural space requirement is also reduced.

In many structural configurations of axial piston machines, the two circular-arc-like elongate holes are constructed as through-holes and arranged in a distributor plate.

In a first embodiment, the first switching valve arrangement is formed by a 3/2-way switching valve, in the first switching position of which the high-pressure store is connected to the first connection location, whilst the second connection location is blocked with respect to the high-pressure store. In a second switching position of the 3/2-way switching valve, the high-pressure store is connected to the second connection location, whilst the first connection location is blocked with respect to the high-pressure store. To this end, the pressure of the first elongate hole acts on the valve body of the 3/2-way switching valve in the direction of the first switching position, whilst the pressure of the second elongate hole acts on the valve body of the 3/2-way switching valve in the direction of the second switching position. In this first embodiment, the precompression of the axial piston machine according to the disclosure with pressure side change is possible using only one switching valve.

In order to configure the lines from the elongate holes as far as the switching valve arrangement to be as short as possible, it is advantageous to remove the control edges. In a second embodiment, therefore, the first switching valve arrangement is formed by a first 2/2-way switching valve and a second 2/2-way switching valve. The pressure of the first elongate hole acts on a valve body of the first 2/2-way switching valve in the direction of an open position, whilst the pressure of the second elongate hole acts on this valve body in the direction of a closure position. The pressure of the first elongate hole acts on a valve body of the second 2/2-way switching valve in the direction of a closure position, whilst the pressure of the second elongate hole acts on this valve body in the direction of an open position. The two 2/2-way switching valves are very simple and standard components can be used. The level of drilling complexity is further low.

In a particularly pulse-reduced axial piston machine, a third connection location is provided in the second transition region adjacent to the first elongate hole in the peripheral direction just behind the first elongate hole, and a fourth connection location is provided in the first transition region adjacent to the second elongate hole in the peripheral direction just behind the second elongate hole. The third and the fourth connection locations can be connected via a second switching valve arrangement to a low-pressure store. To this end, the second switching valve arrangement is connected in fluid terms to the two elongate holes via control pressure lines in such a manner that, if one of the two elongate holes is acted on with high pressure, the third or fourth connection location which is arranged behind in a peripheral direction is connected to the low-pressure store, whilst the other third or fourth connection location is blocked with respect to the low-pressure store. Thus, via the low-pressure store, there may also be carried out in addition a decompression of those cylinders which are moved in the direction away from the elongate hole which is acted on with high pressure.

As a development of the first embodiment, the second switching valve arrangement is formed by a 3/2-way switching valve. In the first switching position thereof, the low-pressure store is connected to the third connection location, whilst the fourth connection location is blocked with respect to the low-pressure store. In a second switching position of the second 3/2-way switching valve, the low-pressure store is connected to the fourth connection location, whilst the third connection location is blocked with respect to the low-pressure store. To this end, the pressure of the second elongate hole acts on the valve body of the 3/2-way switching valve in the direction of the second switching position, whilst the pressure of the first elongate hole acts on the valve body of the 3/2-way switching valve in the direction of the first switching position.

As a development of the second embodiment, the second switching valve arrangement is formed by a third 2/2-way switching valve and a fourth 2/2-way switching valve.

BRIEF DESCRIPTION OF THE DRAWINGS

Two embodiments of an axial piston machine according to the disclosure are illustrated in the Figures, in which.

DETAILED DESCRIPTION

Figure 1:
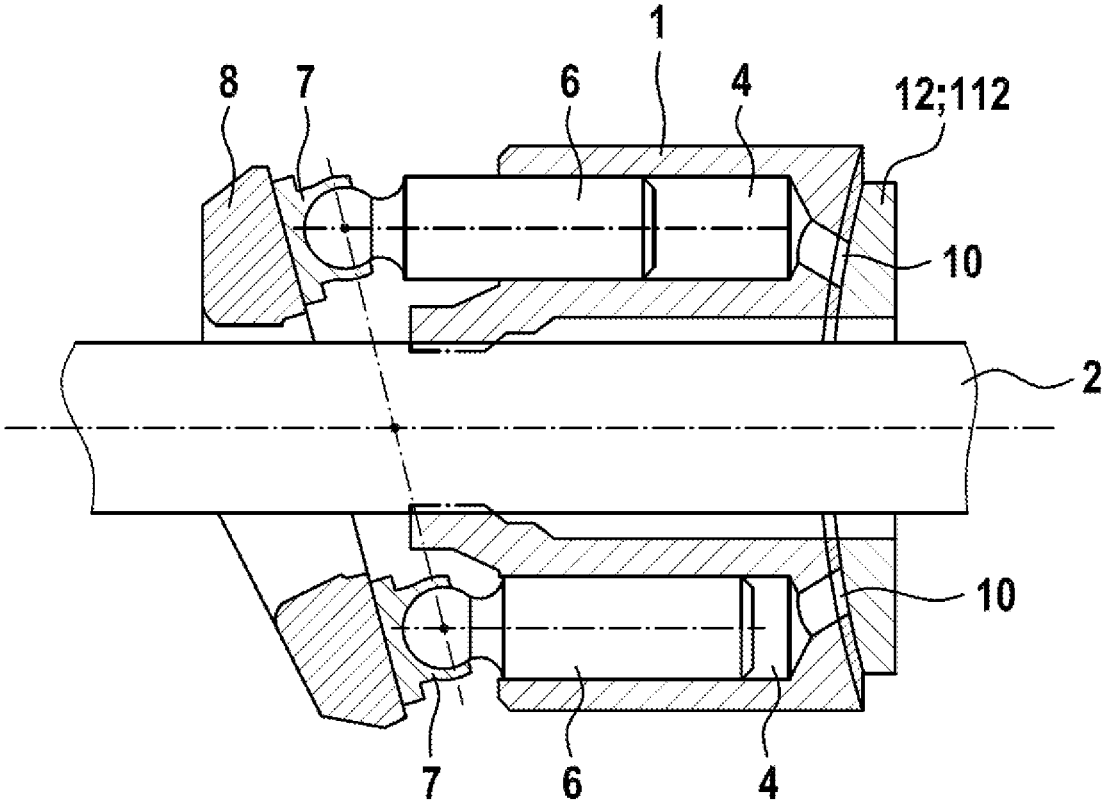
FIG. 1 is a longitudinal section of significant components of the axial piston machine in which the two embodiments of the disclosure according to FIGS. 1 and 2 are produced.

FIG. 1 is a schematic, sectioned view of significant components of an axial piston machine of the swash plate construction type. A cylinder drum 1 is coupled to a drive shaft 2 in a rotationally secure manner so that they rotate together. Along the drive shaft 2, there extend in the cylinder drum 1 cylinders 4 which are distributed in a uniform manner over the periphery and in which pistons 6 are displaceably guided. The pistons 6 are coupled by means of respective piston bases and sliding blocks which rotate therewith to a stationary swash plate 8 which is positioned in an oblique manner with respect to the drive shaft 2. Therefore, with each rotation about the drive shaft 2, each piston 6 carries out a stroke, the size of which is dependent on the oblique position of the swash plate 8.

At an end face of the cylinder drum 1 at the side opposite the swash plate 8 for each cylinder 4 there is provided an opening 10 which is connected to the respective cylinder 4 by means of a respective connection channel 11. The end face rotates and is tensioned with the peripheral openings 10 thereof against a stationary distributor plate 12; 112 which is secured to a housing (not illustrated) of the axial piston machine.

Figure 2:
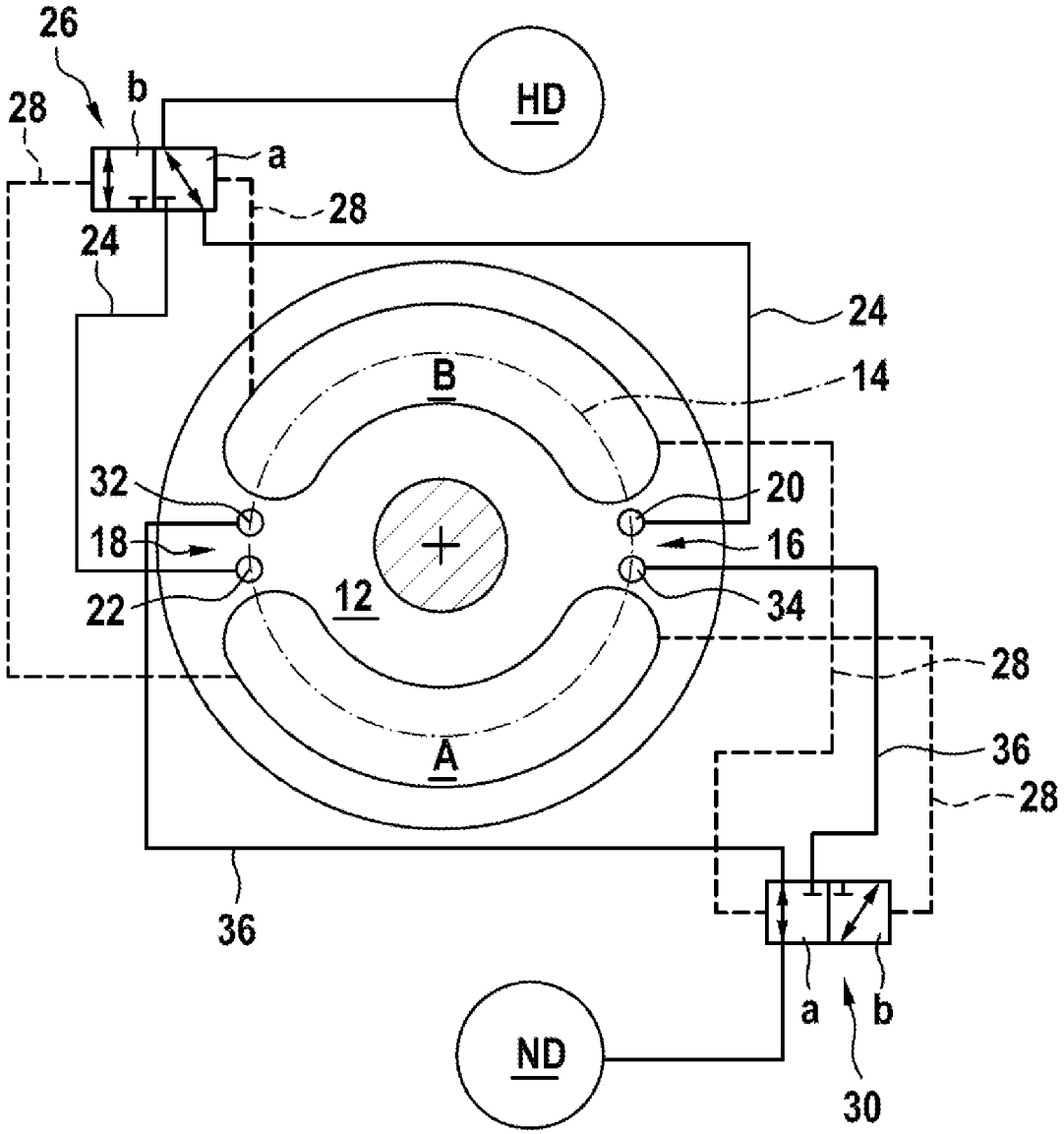
FIG. 2 shows a distributor plate having a hydraulic circuit diagram in a first embodiment of the disclosure.
Figure 3:
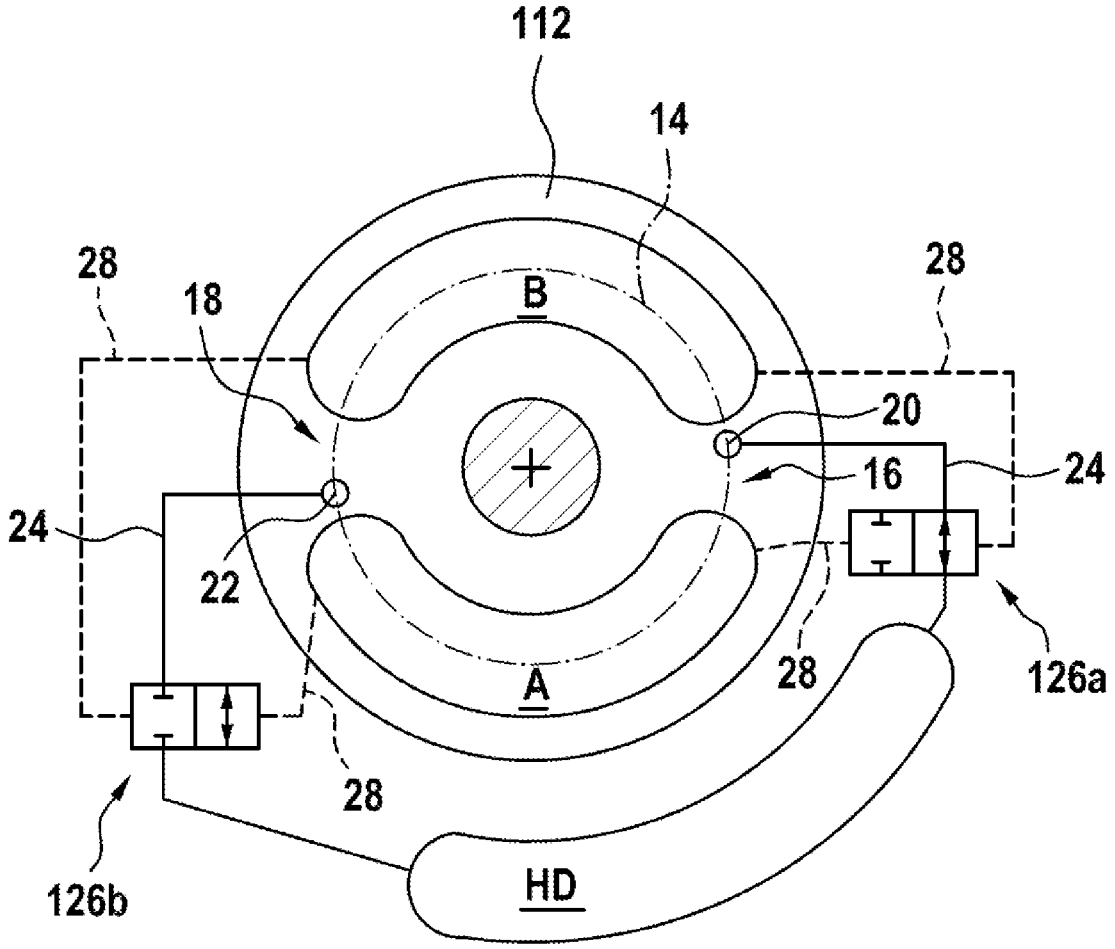
FIG. 3 shows a distributor plate having a hydraulic circuit diagram in a second embodiment of the disclosure.

FIGS. 2 and 3 each show such a distributor plate 12; 112. It can be seen that the distributor plates 12; 112 have circular-arc-like or kidney-like elongate holes A, B. Depending on the operating state, one of the elongate holes A, B is at the high-pressure side and the other elongate hole B, A is at the low-pressure side. The peripheral openings 10 are guided along a circular path 14 in a sealed manner via these elongate holes A, B.

In FIGS. 2 and 3, a rotation or a revolution of the openings 10 (cf. FIG. 1) along the circular path 14 in a counter-clockwise direction is assumed and it is further assumed that the first elongate hole B is at the high-pressure side, whilst the second elongate hole A is at the low-pressure side. When viewed in a peripheral direction, a planar first transition region 16 is provided behind the low-pressure-side second elongate hole A and in front of the high-pressure-side first elongate hole B, whilst diametrically opposite a second transition region 18 is provided behind the high-pressure-side first elongate hole B and in front of the low-pressure-side second elongate hole A. The two transition regions 16, 18 seal the respective opening 10 and consequently the respective cylinders 4 according to the prior art with respect to a housing interior.

According to FIGS. 2 and 3, a first connection location 20 is provided in the first transition region 16 in a peripheral direction directly in front of the first high-pressure-side elongate hole B, whilst a second connection location 2 is provided in the peripheral direction directly in front of the low-pressure-side second elongate hole A. The two connection locations 20, 22 are constructed as small holes perpendicularly to the surface of the distributor plate 12 and thus act as openings which are moved into fluidic contact with the openings 10 of the cylinders 4 which run over them (cf. FIG. 1).

According to the first embodiment from FIG. 2, the two connection locations 20, 22 are connected by means of a respective precompression line 24 to a common 3/2-way switching valve 26. A valve body of the 3/2-way switching valve 26 is acted on by means of a control pressure line 28 with the operating pressure of the first high-pressure-side elongate hole B in the direction of the switching position a (shown in FIG. 2), in which a high-pressure store HD is connected to the first connection location 20. In contrast, the valve body of the 3/2-way switching valve 26 is acted on via a control line 28 with the pressure of the second low-pressure-side elongate hole A in the direction of a switching position b, in which the second connection location 22 is connected to the high-pressure store HD.

A switching of the 3/2-way switching valve 26 is carried out in a passive and automatic manner if the second elongate hole A is intended to be acted on with high pressure, whilst the first elongate hole B is acted on with low pressure. Consequently, the second connection location 22 is connected to the high-pressure store HD so that the compression of the openings 10 which run in a counter-clockwise direction (cf. FIG. 1) is carried out before reaching the second elongate hole A.

In principle, the second embodiment from FIG. 3 is consequently comparable in terms of function with the first embodiment of FIG. 2 as described until this point. In this instance, in FIG. 3, the 3/2-way switching valve 26 from FIG. 2 is replaced by two 2/2-way switching valves 126*a*, 126*b* which are separated from each other. The first 2/2-way switching valve 126*a* connects the first connection location 20 which, when viewed in a peripheral direction, is arranged directly in front of the high-pressure-conducting first elongate hole B to the high-pressure store HD. The second 2/2-way switching valve 126*b* locks in this instance the second connection location 22 which is arranged in a peripheral direction in front of the low-pressure-side second elongate hole A with respect to the high-pressure store HD. To this end, both 2/2-way switching valves 126*a*, 126*b* have a connection via a control pressure line 28 to the first elongate hole B and to the second elongate hole A.

Also, in the second embodiment according to FIG. 3, in the event of a pressure side change between the two elongate holes A, B, the second connection location 22 at the input of the now high-pressure-conducting second elongate hole A is connected to the high-pressure store HD, whilst the first connection location 20 is separated from the high-pressure store HD. To this end, both 2/2-way switching valves 126*a*, 126*b* switch into the respective switching position not shown in FIG. 3.

With regard to FIG. 2, a second portion of the first embodiment of the pulse reduction device shown is explained. The second portion has a low-pressure store ND, another 3/2-way switching valve 30 with control pressure lines 28 at both sides. Furthermore, a third connection location 32 is provided in the first transition region 16 between the second elongate hole A and the first connection location 20. In a similar manner, a fourth connection location 34 is provided in the second transition region 18 between the first elongate hole B and the second connection location 22. The third connection location 32 and the fourth connection location 34 are also arranged on the circular path 14.

The third connection location 32 and the fourth connection location 34 are connected via a respective decompression line 36 to the additional 3/2-way switching valve 30. With this second portion of the pulse reduction device according to the disclosure, a decompression of the openings 10 or cylinders 4 which move thereover (cf. FIG. 1) in the peripheral direction behind the elongate hole A, B which is acted on with high pressure is brought about. If the first elongate hole B is acted on with high pressure, this decompression takes place at the fourth connection location 34 before the corresponding opening 10 moves over the elongate hole A which is acted on with low pressure. To this end, the additional 3/2-way switching valve 30 is in the switching position a shown in FIG. 2. If a pressure side change takes place and the second elongate hole A is acted on with high pressure, the decompression takes place at the third connection location 32, for which purpose the additional 3/2-way switching valve 30 is moved into the switching position b.

There is disclosed a hydrostatic axial piston machine having a pulse reduction device. This device has a connection location 20, 22 or tap in the transition region 16, 18 in front of the high-pressure-side kidney-like elongate hole A, B of a distributor plate 12; 112. The connection location 20, 22 or tap is connected by means of one or two hydraulically passively controlled switching valves 26; 126*a*, 126*b* to a high-pressure store HD. It is used for precompression and consequently for the pulse reduction.

In a development, the distributor plate 12 also has a connection location 32, 34 or tap in the transition region 16, 18 behind the high-pressure-side kidney-like elongate hole A, B. The connection location 32, 24 or tap is connected via one or two hydraulically passively controlled switching valves 30 to a low-pressure store ND. This is used for the decompression and consequently also for the pulse reduction.

LIST OF REFERENCE NUMERALS

1 Cylinder drum
2 Drive shaft

4 Cylinder
6 Piston
7 Sliding block
8 Swash plate
10 Opening
12;112 Distributor plate
14 Circular path
16 First transition region
18 Second transition region
20 First connection location
22 Second connection location
24 Precompression line
26 3/2-way switching valve
28 Control pressure line
30 (Additional) 3/2-way switching valve
32 Third connection location
34 Fourth connection location
36 Decompression line
126*a* First 2/2-way switching valve
126*b* Second 2/2-way switching valve
A Second elongate hole
B First elongate hole
a Switching position
b Switching position
HD High-pressure store
ND Low-pressure store

What is claimed is:

1. A hydrostatic axial piston machine comprising:

a rotating cylinder drum;

a plurality of cylinders formed in the rotating cylinder drum, each of the plurality of cylinders connected by a respective opening to an end face of the rotating cylinder drum;

a distributor plate including a first circular-arc-like elongate hole and a second circular-arc-like elongate hole, wherein each of the plurality openings is configured to move along a circular path, and the end face is tensioned against the distributor plate, a first connection location provided in a first transition region between the two elongate holes and adjacent to the first elongate hole, and a second connection location provided in a second transition region between the two elongate holes and adjacent to the second elongate hole;

a first switching valve arrangement;

a high-pressure store; and a first and a second control pressure line operably connected to the first switching valve and configured such that when the first circular-arc-like elongate hole is acted on with high pressure, the first connection location is connected to the high-pressure store through the first switching valve and the second connection location is blocked from the high-pressure store by the first switching valve, and when the second circular-arc-like elongate hole is acted on with high pressure, the second connection location is connected to the high-pressure store through the first switching valve and the first connection location is blocked from the high-pressure store by the first switching valve.

2. The hydrostatic axial piston machine according to claim 1, wherein:

the first switching valve arrangement comprises a 3/2-way switching valve having a first switching position and a second switching position;

in the first switching position the high-pressure store is connected to the first connection location and the second connection location is blocked from the high-pressure store;

in the second switching position the high-pressure store is connected to the second connection location and the first connection location is blocked from the high-pressure store;

pressure at the first elongate hole acts on a valve body of the 3/2-way switching valve in a direction toward the first switching position; and pressure at the second elongate hole acts on the valve body of the 3/2-way switching valve in a direction toward the second switching position.

3. The hydrostatic axial piston machine according to claim 1, wherein the first switching valve arrangement comprises a first 2/2-way switching valve and a second 2/2-way switching valve:

a pressure of the first elongate hole acts on a valve body of the first 2/2-way switching valve in a direction of an open position and a pressure of the second elongate hole acts on the valve body of the first 2/2-way switching valve in a direction of a closure position; and the pressure of the first elongate hole acts on a valve body of the second 2/2-way switching valve in a direction of a closure position and the pressure of the second elongate hole acts on the valve body of the second 2/2-way switching valve in a direction of an open position.

4. The hydrostatic axial piston machine according to claim 2, further comprising:

a third connection location in the second transition region adjacent to the first elongate hole;

a fourth connection location provided in the first transition region adjacent to the second elongate hole;

a second switching valve arrangement;

a low-pressure store; and a third and fourth control pressure line operably connected to the second switching valve and configured such that when the first circular-arc-like elongate hole is acted on with high pressure, the third connection location is connected to the low-pressure store through the second switching valve and the fourth connection location is blocked from the low-pressure store by the second switching valve, and when the second circular-arc-like elongate hole is acted on with high pressure, the fourth connection location is connected to the low-pressure store through the second switching valve and the third connection location is blocked from the low-pressure store by the second switching valve.

5. The hydrostatic axial piston machine according to claim 4, wherein:

the second switching valve arrangement comprises a further 3/2-way switching valve having a third switching position and a fourth switching position;

in the third switching position the low-pressure store is connected to the third connection location and the fourth connection location is blocked from the low-pressure store;

in the fourth switching position the low-pressure store is connected to the fourth connection location and the third connection location is blocked from the low-pressure store;

pressure at the second elongate hole acts on a valve body of the further 3/2-way switching valve in a direction toward the fourth switching position; and pressure at the first elongate hole acts on the valve body of the further 3/2-way switching valve in a direction toward the third switching position.

6. The hydrostatic axial piston machine according to claim 4, wherein the second switching valve arrangement comprises a third 2/2-way switching valve and a fourth 2/2-way switching valve.

* * * * *